US009945157B2

(12) United States Patent
Zhang

(10) Patent No.: US 9,945,157 B2
(45) Date of Patent: Apr. 17, 2018

(54) DUAL-RING TUBULAR LOCK ASSEMBLY

(71) Applicant: XIAMEN MAKE SECURITY TECHNOLOGY CO., LTD., Xiamen (CN)

(72) Inventor: Jiehao Zhang, Xiamen (CN)

(73) Assignee: XIAMAN MAKE SECURITY TECHNOLOGY CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/613,289

(22) Filed: Jun. 5, 2017

(65) Prior Publication Data

US 2018/0058104 A1 Mar. 1, 2018

(30) Foreign Application Priority Data

Aug. 31, 2016 (CN) ..... 2016 2 1016202 U

(51) Int. Cl.

| | |
|---|---|
| ***E05B 19/02*** | (2006.01) |
| ***E05B 27/08*** | (2006.01) |
| ***E05B 55/00*** | (2006.01) |
| ***E05B 9/04*** | (2006.01) |
| *E05B 19/00* | (2006.01) |

(52) U.S. Cl.

CPC ..... *E05B 55/005* (2013.01); *E05B 9/041* (2013.01); *E05B 19/0047* (2013.01); *E05B 27/08* (2013.01); *E05B 27/083* (2013.01); *Y10T 70/7593* (2015.04); *Y10T 70/7853* (2015.04)

(58) Field of Classification Search

CPC ..... E05B 19/0041; E05B 19/0047; E05B 55/005; E05B 9/041; E05B 27/02; E05B 27/08; E05B 27/083; E05B 27/086; Y10T 70/7593; Y10T 70/7621; Y10T 70/7853

USPC ..... 70/358, 359, 378, 392, 403, 404, 409, 70/419, 420, 491, 496, DIG. 37

See application file for complete search history.

(56) References Cited

U.S. PATENT DOCUMENTS 1,458,520 A * 6/1923 Castell ..... E05B 27/08 70/356
1,978,781 A * 10/1934 Berger ..... E05C 19/10 200/37 R
1,994,095 A * 3/1935 Caldwell ..... E05B 15/06 70/120
2,021,443 A * 11/1935 Deutsch ..... E05B 27/086 70/384
2,024,030 A * 12/1935 Deutsch ..... E05B 27/086 70/384

(Continued)

*Primary Examiner* — Lloyd A Gall
(74) *Attorney, Agent, or Firm* — Leong C. Lei

(57) ABSTRACT

A dual-ring tubular lock assembly is provided. Inner and outer walls of a key are formed with inner-ring and outer-ring notches. A lock cylinder is inserted in a central through hole of a lock housing. A front end of the lock cylinder is formed with a tubular keyhole. The tubular keyhole is formed with inner-ring and outer-ring grooves corresponding to the inner-ring and outer-ring notches and mounted with inner-ring and outer-ring key pins. A rear end of the lock cylinder passes through a central perforation of a lower bead seat and extends out of the lock housing. The lower bead seat is fixed in the center through hole. The lower bead seat is formed with inner-ring and outer-ring holes corresponding to the inner-ring and outer-ring grooves and mounted with inner-ring and outer-ring driver pins and springs. The latch is fixed to the rear end of the lock cylinder.

7 Claims, 7 Drawing Sheets

(56) References Cited

U.S. PATENT DOCUMENTS 2,089,300 A * 8/1937 Schlitz ..... E05B 27/083 70/23
3,524,335 A * 8/1970 George ..... E05B 27/083 70/388
3,661,001 A * 5/1972 Glass ..... E05B 63/003 70/388
4,006,615 A * 2/1977 Szova ..... E05B 27/083 70/395
5,024,072 A * 6/1991 Lee ..... E05B 19/04 70/404
5,245,143 A * 9/1993 James ..... H01H 27/06 200/336
5,402,660 A * 4/1995 Osada ..... E05B 19/00 70/395
5,685,184 A * 11/1997 Gallagher ..... E05B 17/04 70/358
6,718,808 B2 * 4/2004 Yu ..... E05B 27/083 70/386
7,150,168 B1 * 12/2006 Kuo ..... E05B 27/083 70/404
7,162,900 B1 * 1/2007 Lu ..... E05B 19/18 70/398
7,171,833 B1 * 2/2007 Wu ..... E05B 27/083 70/360
7,454,934 B2 * 11/2008 Lin ..... E05B 27/005 70/351
7,647,798 B1 * 1/2010 Jones ..... E05B 27/0017 70/337
2008/0105016 A1 * 5/2008 Uliano ..... E05B 27/083 70/491
2009/0293563 A1 * 12/2009 Jeng ..... E05B 27/0032 70/359
2011/0083479 A1 * 4/2011 Hsu ..... E05B 27/083 70/57.1

* cited by examiner

DUAL-RING TUBULAR LOCK ASSEMBLY

BACKGROUND OF THE INVENTION

1. Field of the Invention

The present invention relates to a dual-ring tubular lock assembly.

2. Description of the Prior Art

A tubular lock has a tubular key hole, and the corresponding key is tubular in shape. When the correct tubular key is inserted into the tubular keyhole, the key pushes the pins in the lock to a specific position, allowing the lock cylinder to turn relative to the lock housing, and then the lock cylinder drives the latch to turn so as to undo the lock. If the key is incorrect, it is unable to undo the lock.

Only the outer edge of the tubular key is formed with notches, and only the outer wall of the tubular keyhole is mounted with pins. The number of the variations of the key bittings is few, so the security of the conventional tubular lock is poor. Accordingly, the present invention intends to provide a dual faucet structure for improving the shortcomings mentioned above.

SUMMARY OF THE INVENTION

The primary object of the present invention is to provide a dual-ring tubular lock assembly which has a simple structure and high security.

In order to achieve the aforesaid object, the dual-ring tubular lock assembly comprises a key, a lock housing, inner-ring key pins, outer-ring key pins, a lock cylinder, inner-ring driver pins, outer-ring driver pins, springs, a lower bead seat, and a latch. The key is tubular in shape. An inner wall and an outer wall of the key are formed with inner-ring notches and outer-ring notches, respectively. The lock housing has a central through hole. A front end of the central through hole is formed with a stop step. The lock cylinder is movably inserted in the central through hole. A front end of the lock cylinder is formed with a tubular keyhole for insertion of the key. The front end of the lock cylinder is provided with a positioning structure cooperating with the key. The tubular keyhole is formed with inner-ring grooves and outer-ring grooves corresponding to the inner-ring notches and the outer-ring notches of the key, respectively. The inner-ring key pins and the outer-ring key pins are mounted in the inner-ring grooves and the outer-ring grooves, respectively. A rear end of the lock cylinder passes through a central perforation of the lower bead seat and extends out of the lock housing. The lower bead seat is fixed in the central through hole. The lower bead seat is formed with inner-ring holes and outer-ring holes corresponding to the inner-ring grooves and the outer-ring grooves, respectively. The inner-ring driver pins and the outer-ring driver pins as well as the springs are mounted in the inner-ring holes and the outer-ring holes, respectively. The latch is fixed to the rear end of the lock cylinder.

Preferably, the inner wall and the outer wall of the key are circular.

Preferably, the inner wall and the outer wall of the key are polygonal.

Preferably, a side wall of the lower bead seat is formed with a pin hole. The lock housing is formed with a side hole corresponding to the pin hole. A fixing pin is inserted in the side hole and the pin hole. The lower bead seat is fixed in the central through hole of the lock housing through the fixing pin. Preferably, the positioning structure includes an axial groove disposed at the front end of the lock cylinder and a rib disposed on the key. Through the rib and the axial groove, the key can be positioned in the lock cylinder, allowing the key to turn the lock cylinder.

Preferably, a front end of an outer surface of the lock housing is formed with an engaging ring. A big nut is fitted on the outer surface of the lock housing.

Preferably, the rear end of the lock cylinder is sleeved with a stop plate, the latch, and a washer. The stop plate is located behind the lock housing and the lower bead seat. The latch is located behind the stop plate. The washer is located behind the latch. The rear end of the lock cylinder is formed with threads to mate with a small nut. The stop plate, the latch and the washer are positioned by means of the small nut.

According to the aforesaid, the present invention has a simple structure. The inner and outer walls of the key are respectively formed with the inner-ring notches and the outer-ring notches by milling. The inner-ring key pins, the outer-ring key pins, the inner-ring driver pins, and the outer-ring driver pins are mounted corresponding to the inner-ring notches and the outer-ring notches. With the increase or decrease in diameter of the tubular key, the number of the inner-ring notches, the outer-ring notches and the key pins is increased or decreased and the number of the variations of the key bittings is also increased or decreased. Moreover, the dual-ring structure of the tubular lock increases the number of the variations of the key bitting greatly to improve the security of the lock. The use of different levels of the pins increases the difficulty of unlocking.

DETAILED DESCRIPTION OF THE PREFERRED EMBODIMENTS

Embodiments of the present invention will now be described, by way of example only, with reference to the accompanying drawings.

Figure 1:
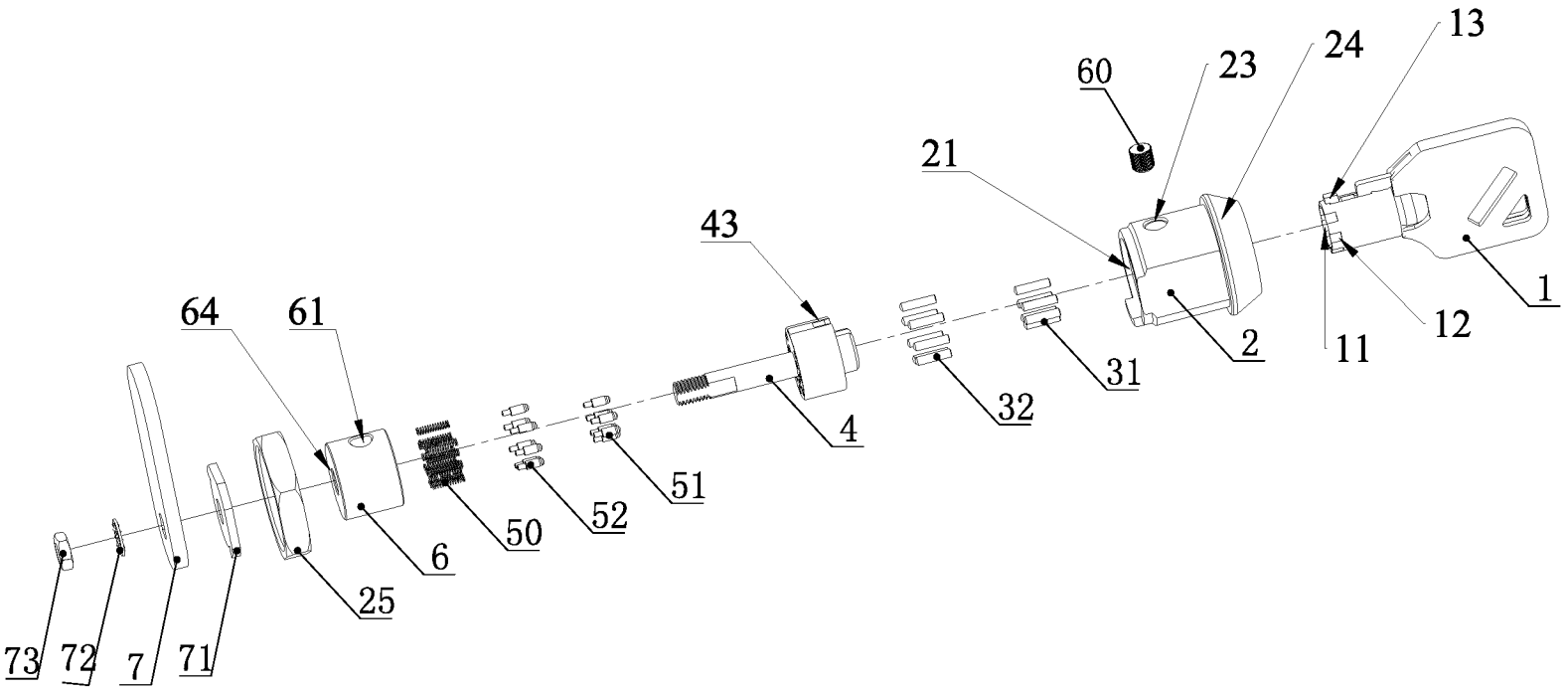
FIG. 1 is an exploded view of the present invention.
Figure 2:
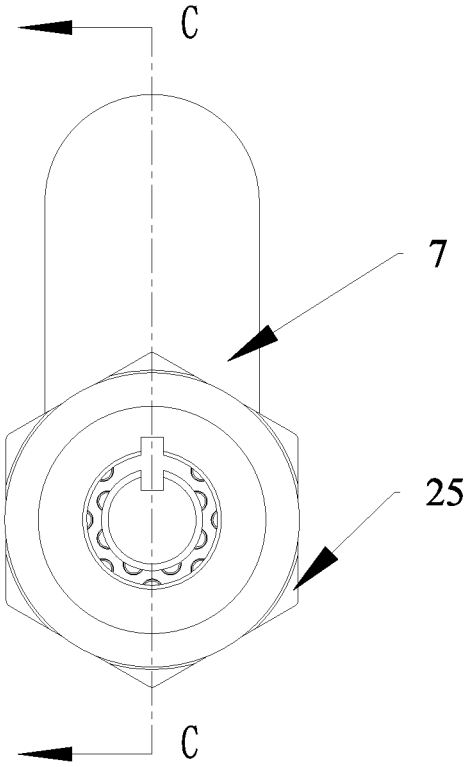
FIG. 2 is a schematic view of the present invention.
Figure 3:
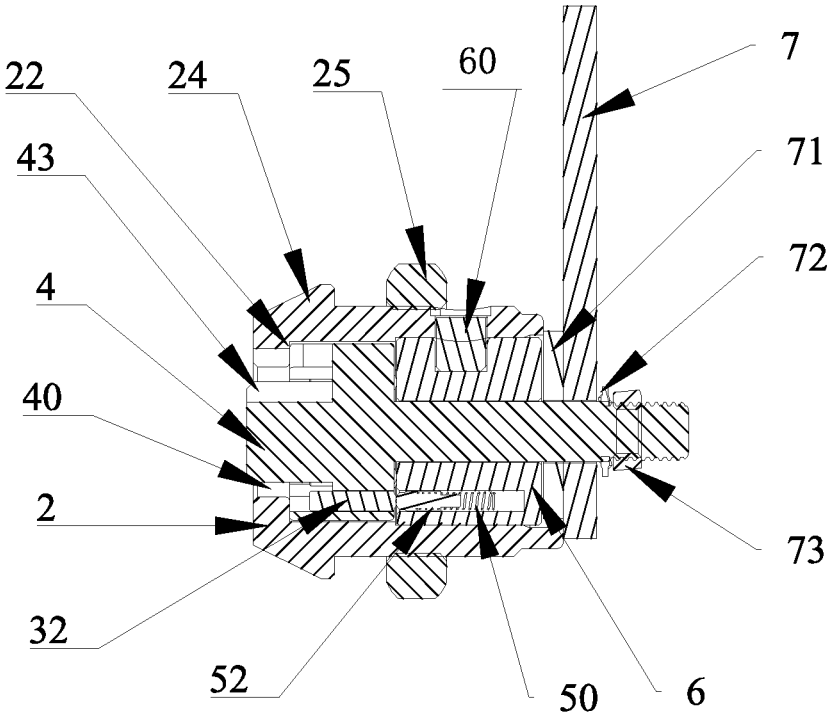
FIG. 3 is a sectional view taken along line C-C of FIG. 2.
Figure 4:
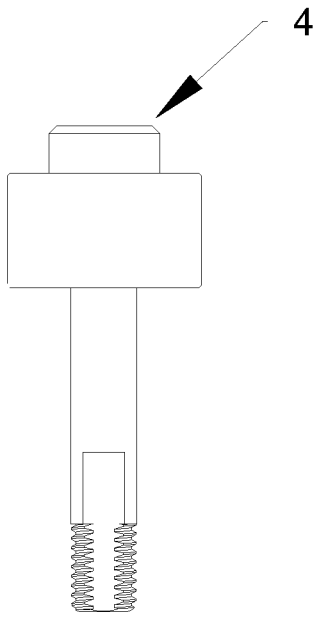
FIG. 4 is a schematic view of the lock cylinder of the present invention.
Figure 5:
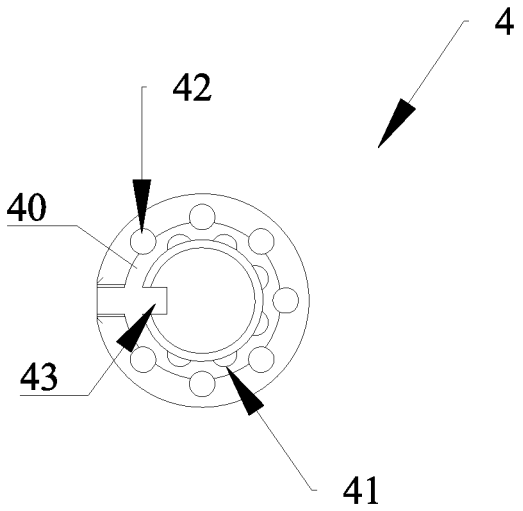
FIG. 5 is a top view of the lock cylinder of the present invention.
Figure 6:
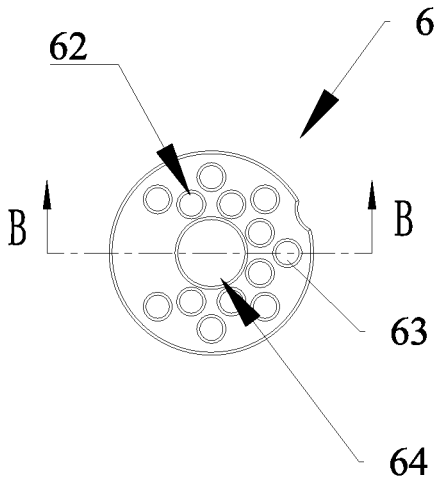
FIG. 6 is a top view of the lower bead seat of the present invention.
Figure 7:
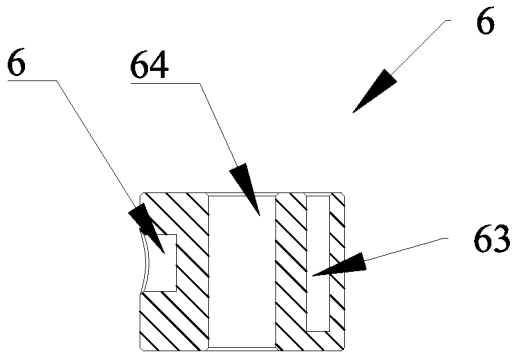
FIG. 7 is a sectional view taken along line B-B of FIG. 6.
Figure 8:
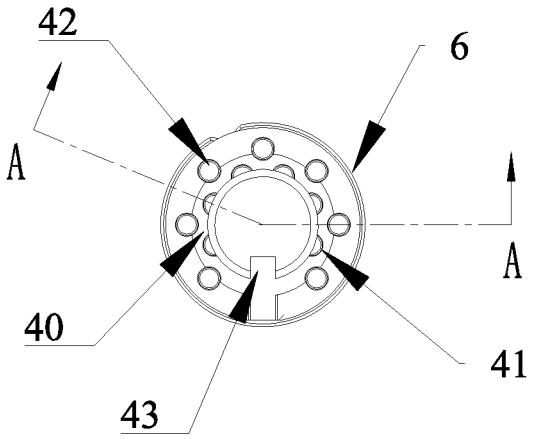
FIG. 8 is a top view of the lock cylinder and the lower bead seat of the present invention.
Figure 9:
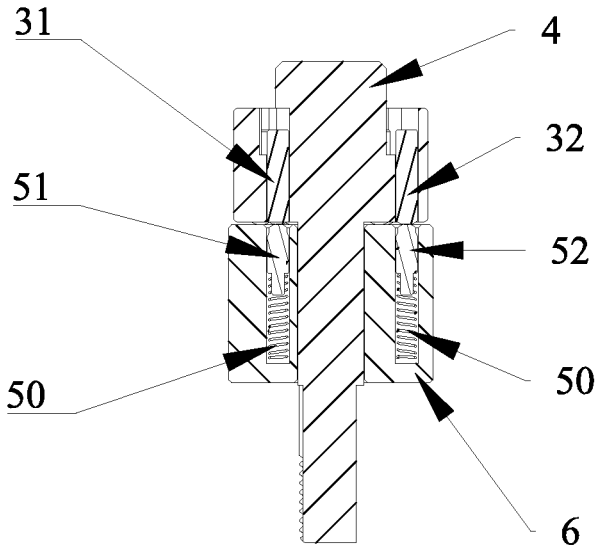
FIG. 9 is a sectional view taken along line A-A of FIG. 8.
Figure 10:
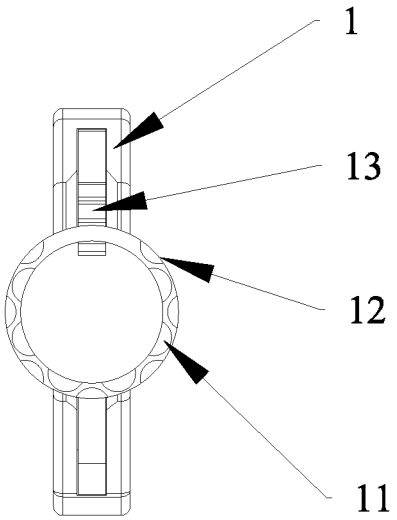
FIG. 10 is a bottom view of the key of the present invention.

As shown in FIG. 1 to FIG. 10, the present invention discloses a dual-ring tubular lock assembly comprises a key 1, a lock housing 2, inner-ring key pins 31, outer-ring key pins 32, a lock cylinder 4, inner-ring driver pins 51, outer-ring driver pins 52, springs 50, a lower bead seat 6, and a latch 7.

The key 1 is tubular in shape. An inner wall and an outer wall of the tubular key 1 are formed with inner-ring notches 11 and outer-ring notches 12, respectively. The inner wall and the outer wall of the tubular key 1 may be circular or polygonal.

The lock housing 2 has a central through hole 21. A front end of the central through hole 21 is formed with a stop step 22 which serves to block the lock cylinder 4 from coining out.

The lock cylinder 4 is movably inserted in the central through hole 21. A front end of the lock cylinder 4 is formed with a tubular keyhole 40 for insertion of the tubular key 1. The front end of the lock cylinder 4 is provided with a positioning structure cooperating with the tubular key 1, so that the key 1 can turn the lock cylinder 4 after unlocking. The positioning structure may have various embodiments. In this embodiment, the front end of the lock cylinder 4 is formed with an axial groove 43, and a rib 13 is formed on the tubular key 1. Through the cooperation of the rib 13 and the axial groove 43, the tubular key 1 is positioned in the lock cylinder 4, thereby allowing the key 1 to turn the lock cylinder 4. The tubular keyhole 40 is formed with inner-ring grooves 41 and outer-ring grooves 42 corresponding to the inner-ring notches 11 and the outer-ring notches 12 of the key 1, respectively. The inner-ring key pins 31 and the outer-ring key pins 32 are mounted in the inner-ring grooves 41 and the outer-ring grooves 42, respectively. A rear end of the lock cylinder 4 passes through a central perforation 64 of the lower bead seat 6 and extends out of the lock housing 2.

The lower bead seat 6 is fixed in the central through hole 21. In order to facilitate assembly, a side wall of the lower bead seat 6 is formed with a pin hole 61, and the lock housing 2 is formed with a side hole 23 corresponding to the pin hole 61. A fixing pin 60 is inserted in the side hole 23 and the pin hole 61, so that the lower bead seat 6 is fixed in the central through hole 21 of the lock housing 2 through the fixing pin 60. The lower bead seat 6 is formed with inner-ring holes 62 and outer-ring holes 63 corresponding to the inner-ring grooves 41 and the outer-ring grooves 42, respectively. The inner-ring driver pins 51 and the outer-ring driver pins 52 are mounted in the inner-ring holes 62 and the outer-ring holes 63, respectively. The bottoms of the inner-ring driver pins 51 and the outer-ring driver pins 52 are provided with the springs 50, respectively.

The latch 7 is fixed to the rear end of the lock cylinder 4. There are many specific ways of fixing. In this embodiment, the rear end of the lock cylinder 4 is sleeved with a stop plate 71, the latch 7 and a washer 72. The stop plate 71 is located behind the lock housing 2 and the lower bead seat 6. The latch 7 is located behind the stop plate 71. The washer 72 is located behind the latch 7. The rear end of the lock cylinder 4 is formed with threads to mate with a small nut 73. The stop plate 71, the latch 7 and the washer 72 are positioned by means of the small nut 73.

In order to facilitate the installation of the entire lock, a front end of an outer surface of the lock housing 2 is formed with an engaging ring 24. A big nut 25 is fitted on the outer surface of the lock housing 2. The inner and outer sides of a door are clamped by the engaging ring 24 and the big nut 25, so that the installation of the entire lock is completed.

The present invention has a simple structure. In use, the key 1 is inserted in the keyhole 40. When the inner-ring notches 11 and the outer-ring notches 12 are aligned with the inner-ring key pins 31 and the outer-ring key pins 32, the inner-ring key pins 31 and the inner-ring driver pins 51 as well as the outer-ring key pins 32 and the outer-ring driver pins 52 align with the shear planes of the lock cylinder 4 and the lower bead seat 6. The key is turned to rotate the lock cylinder 4 so as to undo the lock. When the key 1 is pulled out, the inner-ring driver pins 51 and the outer-ring driver pins 52 extend into the lock cylinder 4 by means of the action of the springs 50 to be locked.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A dual-ring tubular lock assembly, comprising a key, a lock housing, inner-ring key pins, outer-ring key pins, a lock cylinder, inner-ring driver pins, outer-ring driver pins, springs, a lower bead seat, and a latch;

the key being tubular in shape, an inner wall and an outer wall of the key being formed with inner-ring notches and outer-ring notches, respectively;

the lock housing having a central through hole, a front end of the central through hole being formed with a stop step;

the lock cylinder being movably inserted in the central through hole, a front end of the lock cylinder being formed with a tubular keyhole for insertion of the key, the front end of the lock cylinder being provided with a positioning structure cooperating with the key, the tubular keyhole being formed with inner-ring grooves and outer-ring grooves corresponding to the inner-ring notches and the outer-ring notches of the key respectively, the inner-ring key pins and the outer-ring key pins being mounted in the inner-ring grooves and the outer-ring grooves respectively, a rear end of the lock cylinder passing through a central perforation of the lower bead seat and extending out of the lock housing;

the lower bead seat being fixed in the central through hole, the lower bead seat being formed with inner-ring holes and outer-ring holes corresponding to the inner-ring grooves and the outer-ring grooves respectively, the inner-ring driver pins and the outer-ring driver pins as well as the springs being mounted in the inner-ring holes and the outer-ring holes, respectively;

the latch being fixed to the rear end of the lock cylinder.

2. The dual-ring tubular lock assembly as claimed in claim 1, wherein the inner wall and the outer wall of the key are circular.

3. The dual-ring tubular lock assembly as claimed in claim 1, wherein the inner wall and the outer wall of the key are polygonal.

4. The dual-ring tubular lock assembly as claimed in claim 1, wherein a side wall of the lower bead seat is formed with a pin hole, the lock housing is formed with a side hole corresponding to the pin hole, a fixing pin is inserted in the side hole and the pin hole, and the lower bead seat is fixed in the central through hole of the lock housing through the fixing pin.

5. The dual-ring tubular lock assembly as claimed in claim 1, wherein the positioning structure includes an axial groove disposed at the front end of the lock cylinder and a rib disposed on the key, through the rib and the axial groove, the key can be positioned in the lock cylinder, allowing the key to turn the lock cylinder.

6. The dual-ring tubular lock assembly as claimed in claim 1, wherein a front end of an outer surface of the lock housing is formed with an engaging ring, and a big nut is fitted on the outer surface of the lock housing.

7. The dual-ring tubular lock assembly as claimed in claim 1, wherein the rear end of the lock cylinder is sleeved with a stop plate, the latch and a washer, the stop plate is located behind the lock housing and the lower bead seat, the latch is located behind the stop plate, the washer is located behind the latch, the rear end of the lock cylinder is formed with threads to mate with a small nut, the stop plate, the latch and the washer are positioned by means of the small nut.

* * * * *